United States Patent [19]

Sleep

[11] Patent Number: 4,682,647

[45] Date of Patent: Jul. 28, 1987

[54] INDICATOR DEVICE FOR A HEAT EXCHANGER

[76] Inventor: Robert Sleep, 4304 Autumn Leaves Dr., Tampa, Fla. 33624

[21] Appl. No.: 827,258

[22] Filed: Feb. 7, 1986

[51] Int. Cl.[4] ..... F28F 7/00

[52] U.S. Cl. ..... 165/11.1; 165/76

[58] Field of Search ..... 165/11.1, 76, 79

[56] References Cited

U.S. PATENT DOCUMENTS

| | | | |
|---|---|---|---|
| 2,047,223 | 7/1936 | Prickett | 165/11.1 X |
| 3,116,394 | 12/1963 | Baxton | 165/76 X |
| 3,267,361 | 8/1966 | Maddox | 165/11.1 X |

FOREIGN PATENT DOCUMENTS

| | | | |
|---|---|---|---|
| 0070397 | 4/1982 | Japan | 165/11 R |
| 0045498 | 3/1983 | Japan | 165/11 R |

*Primary Examiner*—Albert W. Davis, Jr.
*Assistant Examiner*—Randolph A. Smith
*Attorney, Agent, or Firm*—Frijouf, Rust & Pyle

[57] ABSTRACT

An indicator device is disclosed for indicating that a heat exchanger has been disassembled, cleaned, inspected, reconditioned and subsequently reassembled and rebrazed. The device includes an elongate housing which defines an inlet and an outlet port. A first and a second tube plate are spaced axially within the housing and a plurality of heat exchange tubes extend through and between the plates. A first seal is disposed between the plates and the tubes for sealing the tubes relative to the plates and a second seal is disposed between the tube plates and the housing for sealing the tube plates within the housing. An elongate flexible metallic strip having a first and a second end is threaded through one port and around at least one of the tubes and back through the same or opposite port and an indicator seal extends around the first and second ends of the flexible strip for sealingly connecting together the ends of the flexible strip for indicating that the heat exchanger has been disassembled, cleaned, inspected, reconditioned and subsequently reassembled and rebrazed.

23 Claims, 5 Drawing Figures

INDICATOR DEVICE FOR A HEAT EXCHANGER

BACKGROUND OF THE INVENTION

1. Field of the Invention

This invention relates to an indicator device for indicating that a heat exchanger has been disassembled, inspected, reconditioned and subsequently reassembled and rebrazed. More particularly, this invention relates to a flexible strip for threading through the inlet or outlet port around at least one tube and back through the same or opposite port of a heat exchanger, the ends of the flexible strip being sealed to indicate that the heat exchanger has been reassembled and rebrazed after being disassembled, inspected and reconditioned.

2. Information Disclosure Statement

Heavy earth moving equipment and tractors have heat exchanger elements for cooling oil circulating through the engine and hydraulic equipment. These heat exchange units become clogged with carbon and other debris after prolonged usage. Customarily, such heat exchangers have been removed from the earth excavating equipment and have been discarded since the cost of a new heat exchanger is negligible relative the cost of the equipment. Reconditioned heat exchangers provide a cost savings to the purchaser; however, there is presently no positive indication that such heat exchanger has been reconditioned.

Contaminated heat exchangers are salvaged by first melting the brazed joint between the tube plate and housing. The tube bundle is then removed from the housing for cleaning, inspection and repair. The now reconditioned tube bundle is placed back into the housing and is rebrazed to the housing. The problem with this procedure is the purchaser/user is not provided with any assurance that the heat exchanger was disassembled and reconditioned since it is almost impossible to tell an old brazed or welded joint from a new joint.

The present invention seeks to overcome this problem by providing an indicator device which includes a strip or flexible material which can only be threaded through the heat exchanger after the heat exchanger has been disassembled so that when the heat exchanger is reconditioned and subsequently reassembled and rebrazed, the respective ends of the strip of material are sealed together to indicate to the perspective purchaser of the heat exchanger that such heat exchanger has been disassembled, inspected, reconditioned and subsequently reassembled and rebrazed.

Therefore, it is an object of the present invention to provide a device for indicating to a perspective purchaser of a heat exchanger that the heat exchanger has been disassembled, inspected for breaks or defects which allow the coolant fluid and cooled fluid to mix, reconditioned, reassembled and rebrazed by brazing the joint between the tube plate and housing thereby overcoming the aforementioned inadequacies of the prior art.

Another object of the present invention is the provision of a flexible strip of material for indicating that a heat exchanger has been disassembled, inspected, reconditioned and subsequently reassembled and rebrazed.

Another object of the present invention is the provision of an indicator device in which the flexible material is a strip of metal having a first and a second end with the first end threaded through the inlet or outlet port of the heat exchanger housing around at least one of the core tubes and through the same or opposite port of the heat exchanger.

Another object of the present invention is the provision of an indicator device in which the ends of the flexible metallic strip are sealed together by an indicator seal.

Another object of the present invention is to provide an indicator means which extends around the first and second ends of the threaded elongate flexible means for indicating that the heat exchanger has been disassembled, cleaned, inspected, reconditioned and subsequently reassembled and rebrazed.

Another object of the present invention is to provide an indicator device which must be removed from the tube bundle before the heat exchanger unit is re-installed.

Another object of the present invention is to provide an indicator device which can only be threaded through the heat exchanger after the heat exchanger has been disassembled.

Another object of the present invention is to provide an indicator device which includes caps to cover the inlet and outlet ports to prevent the entrance of dirt and debris into the blind contamination area encompassed by the area between the inlet and outlet ports within the rebrazed elongate housing of the heat exchanger while awaiting re-installation.

The foregoing has outlined some of the more pertinent objects of the present invention. These objects should be construed to be merely illustrative of some of the more pertinent features and applications of the invention. Many other beneficial results can be attained by applying the disclosed invention in a different manner or modifying the invention within the scope of the disclosure. Particularly, with regard to the use of the invention described herein, this should not be construed to be limited to heat exchangers for earth moving equipment but should include indicating devices for all application to any heat exchanger unit or the like.

SUMMARY OF THE INVENTION

The indicator device of the present invention is defined by the appended claims with a specific embodiment shown in the attached drawings. For the purpose of summarizing the invention, the invention relates to an indicator device for indicating that heat exchanger has been disassembled, cleaned, inspected, reconditioned and subsequently reassembled and rebrazed. The device includes an elongate housing, the housing defining an inlet port and an outlet port. A first and second tube plate are disposed coaxially within the housing, the plates being spaced relative to each other. A plurality of heat exchanger tubes extend through and between the plates and a first sealing means is disposed between the plates and the tubes for sealing the tubes relative to the plates. A number of baffle plates may be disposed between the first and second tube plates. The tubes are close fit relative the baffles, since a sealed relationship is not required to accomplish the objective of the baffles. A second sealing means is disposed between the tube plates and the housing for sealing the tube plates within the housing. The first and second sealing means generally comprise a metallic alloy which is melted to join and seal the metallic surfaces of the elongate housing and end plate. Preferably, the sealing means is a soldered or brazed joint. An elongate flexible means having a first and a second end with the first end of the flexible means being threaded through the inlet or outlet port and around at least one of the tubes and through the same or opposite port is disclosed. An indicator means extends around the first and second ends of the flexible means for sealingly connecting together the ends of the flexible means for indicating that the heat exchanger has been disassembled, cleaned, inspected, reconditioned and subsequently reassembled and rebrazed by soldering or the like. In another embodiment of the invention, the diameter of the indicator means is larger than the diameter of the port through which the elongated flexible means exit. In another embodiment the elongate flexible means holds a cap in an obstructive position thereby covering the inlet port and the outlet port. These embodiments prevent dirt and debris from entering the blind contamination area within the sealed elongate housing after the heat exchanger has been reconditioned and rebrazed and the indicator means has been sealingly attached to the flexible means. Also, they insure that the indicator device will be removed prior to re-installation in the heat exchanger since the housing port could not be accessed due to the obstruction by the indicator means or cap. Practically, the indicator device must be removed from the heat exchanger housing since the device would inhibit fluid flow therethrough.

The indicator device informs one that the core tubes and their attached end plates and baffles have been removed from the elongate housing by heating the brazed joints located at each end of the exchanger. Upon the heated removal of the brazed joints the core tubes with their end plates and baffles are slidably released from the elongate housing. The elongate housing and core tubes with their attached end plates and baffles are then cleaned, inspected and reconditioned, reassembled and rebrazed together.

More specifically, the indicator device of the present invention includes an elongate housing which is tubular with the inlet and outlet ports are spaced axially against the housing. The tube plates are disposed parallel relative to each other with the distance between the plates being greater than the distance between the inlet and outlet ports. Baffle plates may be disposed between the tube plates and are disposed parallel relative to the end plates. The tubes are disposed parallel relative to each other and the first sealing means includes a plurality of welds between each end of the tubes and an adjacent tube plates, including baffle plates, if any, such that the first heat exchanger fluid flowing through the tubes is in a heat exchange relationship with and sealed from a second heat exchange fluid flowing from the inlet towards the outlet port.

In another embodiment of the present invention the elongate flexible means is a flexible strip of metal, such as a flexible strip of copper foil. In a further embodiment of the present invention, the flexible means is a flexible stainless steel wire or a flat ribbon-like wire mesh. The preferred composition of the elongate flexible means is metallic in order to withstand the heat of rebrazing the tube plates to the elongate housing. Any other composition which can withstand the heat or rebrazing may be used. The flexible means may have a width greater than the diameter of the port (inlet, outlet or both) which requires the removal of the indicator device prior to reinstallation of the heat exchanger and to prevent dirt and contamination from entering the heat exchanger after rebrazing and prior to re-installation.

The first end of the strip of metal is threaded through the inlet or outlet port and around at least one of the tubes and through the same or opposite port prior to reinserting the tube bundle into the housing. While the flexible strip may enter one port and leave the opposite port, the presence of the baffle plates which are disposed parallel to the end plates and between the end plates makes this route more difficult. That is, the strip must be threaded among the tubes for if the strip were placed against the periphery of a baffle, the strip may be accidentally severed. In those applications where a cap is to be positioned over each outlet and inlet port, it may be necessary to position an indicator device at each port, especially where the baffle plates interfere with the threading of the elongated flexible means.

The indicator means is a deformable seal, preferably of lead. The seal defines a first and second passageway for the reception therein of the first and second ends of the flexible means respectively enabling the flexible means to be threaded prior to reassembly of the heat exchanger and for permitting the ends of the flexible means to be deformed and sealed by the seal for indicating the heat exchanger has been reconditioned.

The foregoing has outlined rather broadly the more pertinent and important features of the present invention in order that the detailed description that follows may be better understood so that the present contribution of the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other devices for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in conjunction with the accompanying drawings in which.

Similar reference characters refer to similar parts throughout the several views of the drawings.

DETAILED DESCRIPTION

Figure 1:
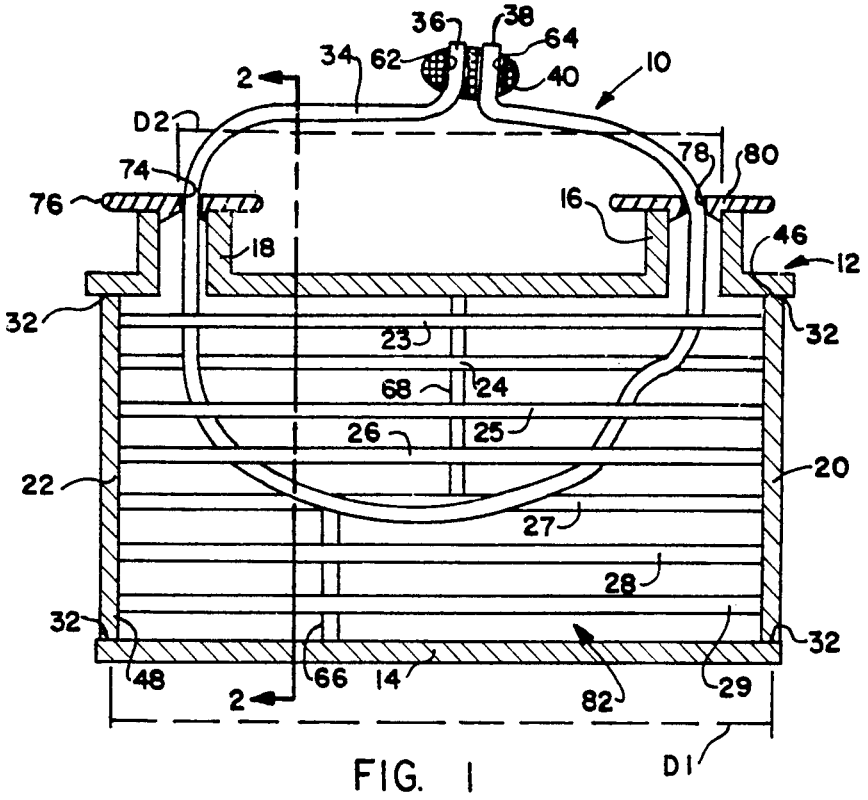
FIG. 1 is a side elevational view partially in section of a heat exchanger having an indicator device according to the present invention.

FIG. 1 is a side elevational view partially in section of a heat exchanger generally designated 12 having an indicator device generally designated 10 according to the present invention. The indicator device 10 is used for indicating that heat exchanger 12 has been disassembled, cleaned, inspected, reconditioned and subsequently reassembled and rebrazed by welding or brazing the end plates to the elongate housing. The device 10 includes an elongate housing 14, the housing defining an inlet port 16 and an outlet port 18. A first and a second tube plate 20 and 22 respectively are disposed within the housing 14 such that the plates 20 and 22 are spaced axially relative to each other within the housing 14. A plurality of heat exchanger tubes 23 to 29 extend through and between the plates 20 and 22. A first sealing means generally designated 30 is disposed between the plates 20 and 22 and the tubes 23 to 29 for sealing the tubes 23 to 29 relative to the plates 20 and 22. A second sealing means generally designated 32 is disposed between the tube plates 20 and 22 and the housing 14 for sealing the tube plates 20 and 22 within the housing 14.

An elongate flexible means generally designated 34 having a first and a second end 36 and 38 respectively is threaded through the inlet port 16 and around at least one, and preferably a plurality of the tubes 23 to 29 around baffles 66 and 68 and back through the outlet port 18. Alternatively, the first and the second ends 36 and 38 of elongate flexible means 34 is threaded through the outlet port 18 and around at least one, and preferably a plurality of the tubes 23 to 29, around baffles 66 and 68, if present, and back through the outlet port 18. The above process can be used relative inlet port 16.

Figure 3:
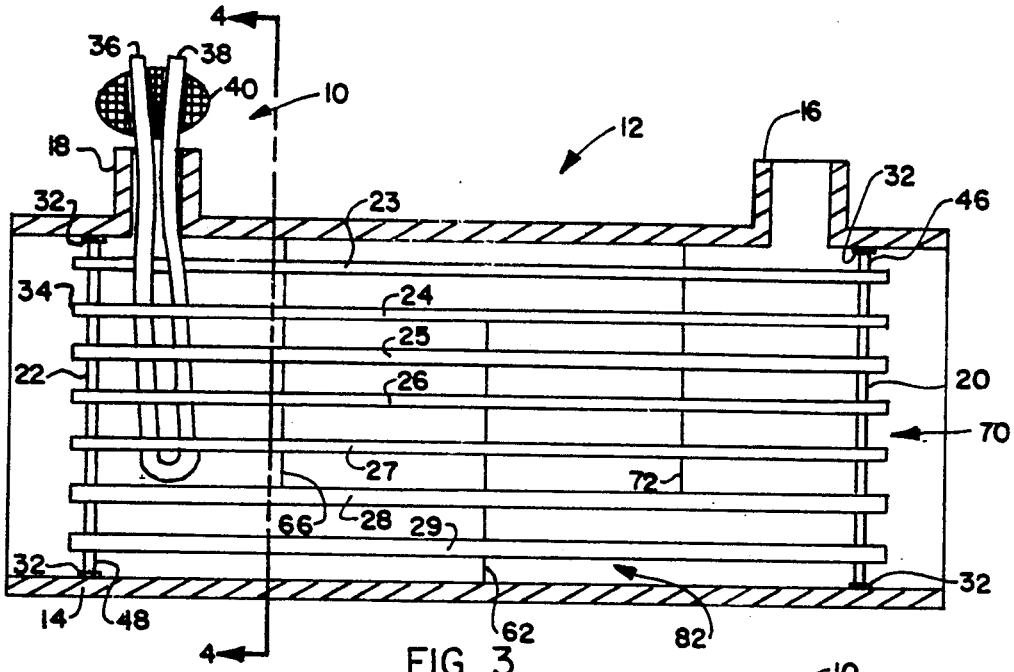
FIG. 3 is a side elevational view partially in section of a heat exchanger having an indicator device according to the present invention.

An indicator means generally designated 40 extends around the first and second ends 36 and 38 respectively of the flexible means 34 for sealingly connecting together the ends 36 and 38 of the flexible means 34 for indicating that the heat exchanger 12 has been disassembled, cleaned, inspected, reconditioned and subsequently reassembled and rebrazed. FIGS. 1 and 3 includes a partial sectional view of indicator means 40 in order to better illustrate the first 62 and second 64 passageways. Preferably, the diameter of indicator means 40 is larger than the diameter of the port through which the elongated flexible means exit.

In another embodiment elongate flexible means 34 has a width greater than the diameter of inlet port 16 or outlet port 18 to further enable flexible means 34 to retard dirt and debris from entering through port through which the flexible means 34 enters and exits. This obviously, could be inlet port 16, outlet port 18 or both ports 16 and 18 after the heat exchanger has been reconditioned and rebrazed and the indicator means 40 has been sealingly attached but prior to reinstallation.

In another embodiment of the invention, elongate flexible means 34 having a first and a second end 36 and 38 respectively is threaded through aperture 74 in cap 76 and inlet port 16 and around at least one, and preferably a plurality of the tubes 23 to 29 around baffles 66 and 68 and back through the outlet port 18 and through aperture 78 of cap 80. An indicator means 40 extends around the first and second ends 36 and 38 respectively of the flexible means 34 for sealingly connecting together the ends 36 and 38 of the flexible means 34 for indicating that the heat exchanger 12 has been disassembled, cleaned, inspected, reconditioned and subsequently reassembled and rebrazed. The indicator means also holds an obstructive position cap 76,80 over inlet port 16 and outlet port 18, respectively. The same process can be used relative inlet port 16 or outlet port 18 to obstructively position cap 76 over a single port 18. Cap 76,80 retards dirt and debris from entering through the port covered by cap 76,80 prior to installation and is held in place by flexible means 34. Flexible means 34 may be slightly tensioned when the indicator means is attached to aid in maintaining the position of caps 76,80. At the time of installation, flexible means 34 is cut and the indicator device 10 is removed from the heat exchanger 12. This embodiment is set forth at FIG. 1, with cap 76 presented in a sectional view to illustrate flexible means passing therethrough.

More specifically, the indicator device 10 includes the elongate housing 14 which is tubular and the inlet and outlet ports 16 and 18 are spaced axially along the housing 14. Furthermore, the tube plates 20 and 22 are disposed parallel relative to each other with the distance D1 between the plates 20 and 22 being greater than the distance D2 between the inlet and outlet ports 16 and 18 respectively. The tubes 23 to 29 are disposed parallel relative to each other and the first sealing means 30 includes a plurality of welds between each end of the tubes and an adjacent tube plate 20, 22 such that the first heat exchange fluid (not shown) flowing through the tubes 23 to 29 is in heat exchange relationship with and sealed from a second heat exchange fluid (not shown) flowing from the inlet port 16 towards the outlet port 18. A number of baffle plates such as 66, 68 may be disposed between the first and second tube plates 20, 22. The tubes 23–29 are close fit relative the baffle plates 66, 68 to provide a slowing down or a breaking in the force of flow of the heat exchange fluid among the tubes to enhance heat exchange between the cooled and cooling fluids.

The flexible means generally designated 34 is preferably a strip of metal which may be copper foil. The first end 36 of the strip of metal 34 is threaded through the inlet port 16 around at least one of the tubes 23 to 29 and through the outlet port 18 prior to sealing the tube plates 20 and 22 relative to the housing 14. The first end 36 and second end 38 of flexible means 34 may also be threaded through tube bundle 70, pulled through the housing port 16 or 18 as the tube bundle 70 is inserted into housing 14. Flexible means 34 is then pulled fully through the housing port 16 or 18 as the tube bundle 70 is placed in the operable position and brazed 32 about the circumferential edges 46 and 48 to the housing 14.

The indicator means generally designated 40 is a deformable seal, including plastic but preferably of lead. The seal 40 defines a first and a second passageway 62 and 64 respectively for the reception therein of the first and the second ends 36 and 38 of the flexible means 34 respectively enabling the flexible means 34 to be threaded prior to reassembly of the heat exchanger 12 and for permitting the ends of the flexible means 34 to be deformed and sealed by the seal for indicating that the heat exchanger 12 has been reconditioned.

Figure 4:
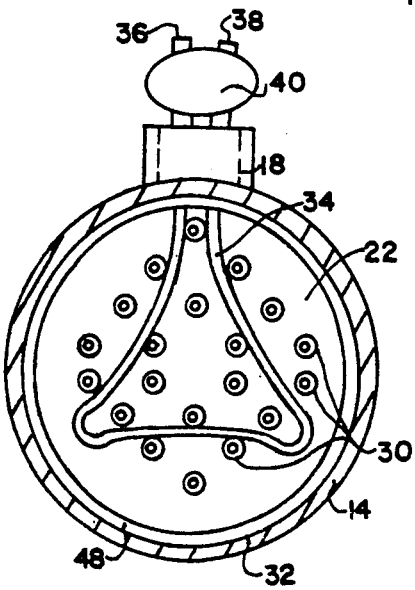
FIG. 4 is a sectional view taken on the line 4—4 of FIG. 3.

FIGS. 3 and 4 illustrate the threading of flexible means 34 into outlet port 18, around and among tubes 24–29, and back through outlet port 18 with indicating means 40 sealingly attaching the first 36 and second 38 ends of flexible means 34.

Figure 5:
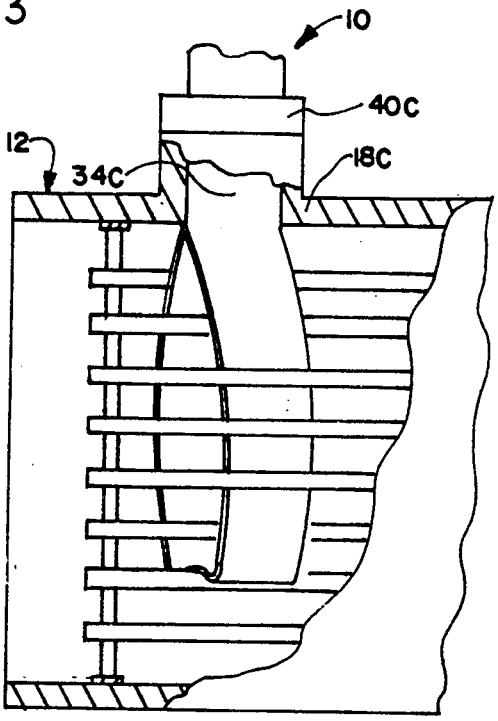
FIG. 5 is a partial side view partially in section of a heat exchanger having an indicator device according to the present invention.

FIG. 5 illustrates the indicator device of the invention 10 where the diameter of the indicator means 40C is larger than the diameter of the port 18C through which the elongated flexible means 34C exits. This configuration prevents dirt and debris from entering the heat exchanger through the covered port after the heat exchanger 12 has been reconditioned and rebrazed.

Figure 2:
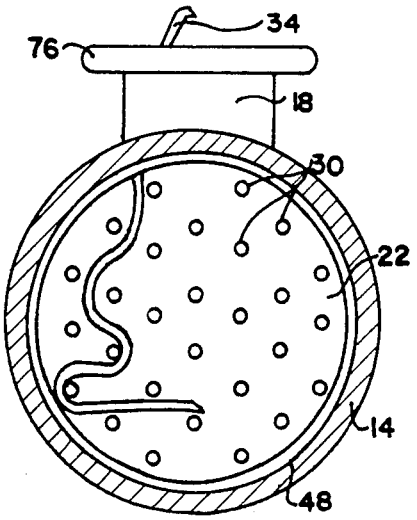
FIG. 2 is a sectional view taken on the line 2—2 of FIG. 1.

In operation of the device according to the present invention, when the heat exchanger 12 has been disassembled, cleaned, inspected and reconditioned, the first end 36 of the flexible strip 34 is threaded through the inlet port 16 or the outlet port 18 of the heat exchanger 12 and is threaded around at least one of the tubes 23 to 29 (FIGS. 1 and 2) and the first end 36 is then threaded through the same (FIGS. 3 and 4) or opposite port 18 of the elongate housing 14. The tubes plates 20 and 22 are assembled within the elongate housing 14 as shown in FIG. 1 and the first and second ends 36 and 38 respectively of the strip of material 34 are threaded through the first and second passageways 62 and 64 of the seal 40. The second seal means 32 is then applied to seal the tube plates 20 and 22 within the elongate housing 14 and the indicator 40 is deformed in order to indicate to a perspective purchaser of the reconditioned heat exchanger unit that such heat exchange unit has been reconditioned.

As discussed above, once the end plates are sealed or rebrazed to the elongate housing, a prospective purchaser cannot ascertain whether or not the heat exchanger has been disassembled, cleaned, inspected, reconditioned and subsequently re-welded absent this device.

The indicating device of the present invention provides a simple and low cost device for indicating to a perspective purchaser a heat exchanger which has been disassembled, cleaned, inspected, reconditioned and subsequently reassembled and rebrazed.

The present disclosure includes that contained in the appended claims as well as that of the foregoing description. Although the invention has been disclosed in its another form with a certain degree of particularity, it is to be understood that the invention of the another form has been made by way of example, and that numerous changes in the details of construction and the combination and arrangement of parts may be resorted to without departing from the spirit and scope of the invention.

What is claimed:

1. An indicator device for a heat exchanger for indicating that the heat exchanger has been disassembled, cleaned, inspected, reconditioned and subsequently rebrazed, said device comprising in combination:

an elongate housing, defining an inlet and an outlet port;

a first and a second tube plate with said plates being spaced axially within said housing;

a plurality of heat exchanger tubes extending through and between said plates;

first sealing means disposed between said plates and said tubes for sealing said tubes relative to said plates;

second sealing means disposed between said tube plates and said housing for sealing said tube plates within said housing;

an elongate flexible means having a first and second end with said first end of said flexible means being threaded into one of said inlet and said outlet ports and extending around at least one of said tubes and being threaded out of one of said inlet and said outlet ports; and an indicator means extending around said first end and said second ends of said flexible means for sealingly connecting together said end of said flexible means for indicating that the heat exchanger has been disassembled, cleaned, inspected, reconditioned and subsequently reassembled and rebrazed.

2. An indicator device as set forth in claim 1 wherein said elongate housing is tubular and said inlet and outlet ports are placed axially along the length of said housing.

3. An indicator device as set forth in claim 2 wherein said tube plates are disposed parallel relative to each other, the distance between said plates being greater than the distance between said inlet and outlet ports.

4. An indicator device as set forth in claim 3 wherein said tubes are disposed parallel relative to each other.

5. The indicator device as set forth in claim 1 wherein said first end of said flexible means is threaded through said inlet port and around at least one of said tubes and back through said inlet port.

6. The indicator device as set forth in claim 1 wherein said first end of said flexible means is threaded through said outlet port and around at least one of said tubes and back through said outlet port.

7. The indicator device as set forth in claim 1 wherein said first end of said flexible means is threaded around a plurality of said tubes.

8. The indicator device as set forth in claim 1 wherein said indicator means has a diameter greater than the diameter of said inlet port to require the removal of said indicator device prior to reinstallation of the heat exchanger and to prevent dirt and debris from entering the heat exchanger after rebrazing and prior to re-installation.

9. The indicator device as set forth in claim 1 wherein said indicator means has a diameter greater than the diameter of said outlet port to require the removal of said indicator device prior to reinstallation of the heat exchanger and to retard dirt and contamination from entering the heat exchanger prior to rebrazing.

10. The indicator device as set forth in claim 1 wherein said flexible means has a width greater than the diameter of said outlet port to require the removal of said indicator device prior to reinstallation of the heat exchanger and to retard dirt and contamination from entering the heat exchanger after rebrazing and prior to re-installation.

11. The indicator device as set forth in claim 1 further includes an inlet port cap and an outlet port cap;

said inlet cap and said outlet cap further including an aperture extending therethrough to enable said flexible means to pass therethrough and to hold said cap relative said port;

said first end of said flexible means being threaded through said aperture in said inlet port cap and then through said inlet port and around at least one of said tubes and back through said outlet port and through said aperture in said outlet port cap to hold said inlet port cap and said outlet port cap relative said inlet port and said outlet port to prevent debris and dirt from entering the heat exchanger after rebrazing and prior to re-installation.

12. An indicator device as set forth in claim 1 wherein said first sealing means includes a plurality of welds between each end of said tubes and an adjacent tube plate such that a inlet heat exchanger fluid flowing through said tubes is in heat exchange relationship with and sealed from a outlet heat exchanger fluid flowing from said inlet towards said outlet port.

13. An indicator device as set forth in claim 1 wherein said second sealing means includes:

an inlet and outlet weld to seal said inlet and said outlet tube plates relative to said housing.

14. An indicator device as set forth in claim 1 wherein said flexible means is a strip of metal.

15. An indicator device as set forth in claim 14 wherein said flexible means is a strip of copper foil.

16. An indicator device as set forth in claim 1 wherein said indicator means is a deformable seal.

17. An indicator device as set forth in claim 16 wherein said indicator means is a lead seal.

18. An indicator device as set forth in claim 16 wherein said seal defines a inlet and outlet passageway for the reception therein of said first and second ends of said flexible means respectively enabling said flexible means to be threaded prior to reassembly of the heat exchanger and for permitting said ends of said flexible means to be deformed and sealed by said seal for indicating that the heat exchanger has been reconditioned.

19. The indicator device as set forth in claim 1 further includes an inlet port cap and an outlet port cap to prevent dirt and debris from entering the heat exchanger after rebrazing and prior to re-installation;

said inlet cap and said outlet cap further including an aperture extending therethrough to enable said flexible means to pass therethrough and to hold said cap relative said port.

20. An indicator device for indicating that a heat exchanger has been disassembled, cleaned, inspected, reconditioned, reassembled and subsequently welded, said device comprising in combination:

an elongate housing, said housing defining an inlet and an outlet port;

a first and a second tube plate, said plates being spaced axially within said housing;

a plurality of heat exchanger tubes extending through and between said plates;

first sealing means disposed between said plates and said tubes for sealing said tubes relative to said plates;

second sealing means disposed between said tube plates and said housing for sealing said tube plates within said housing;

an elongate flexible means having a first and second end;

said flexible means being a strip of metal, said first end of said strip of metal being threaded through said inlet port, around at least one of said tubes and through said outlet port prior to sealing said tube plates relative to said housing; and an indicator means extending around said inlet and said outlet ends of said flexible means for sealingly connecting together said ends of said flexible means for indicating that the heat exchanger has been disassembled, cleaned, inspected, reconditioned and subsequently reassembled and rewelded.

21. The indicator device set forth in claim 20 wherein said first and second sealing means are metallic welds.

22. An indicator device for indicating that a heat exchanger has been disassembled, cleaned, inspected, reconditioned and subsequently reassembled and rewelded, said device comprising in combination:

an elongate housing, said housing defining an inlet and an outlet port;

a first and a second tube plate, said plates being spaced axially within said housing;

a plurality of heat exchanger tubes extending through and between said plates;

first sealing means disposed between said plates and said tubes for sealing said tubes relative to said plates;

second sealing means disposed between said tube plates and said housing for sealing said tube plates within said housing;

an elongate flexible means having a first and second end;

said flexible means being a strip of metal having a first end and a second end said first end of said strip of metal being threaded through said inlet port, around at least one of said tubes and through said outlet port prior to sealing said tube plates relative to said housing;

an indicator means extending around said first and second ends of said flexible means for sealingly connecting together said ends of said flexible means for indicating that the heat exchanger has been disassembled, reconditioned and subsequently reassembled and rebrazed; and said seal defining a inlet and outlet passsageway for the reception therein of said first and second ends of said flexible means respectively enabling said flexible means to be threaded prior to reassembly of the heat exchanger and for permitting said ends of said flexible means to be deformed and sealed for indicating that the heat exchanger has been reconditioned.

23. The indicator device set forth in claim 22 wherein said first and second sealing means are brazed.

* * * * *